US005164098A

United States Patent [19]

Brown et al.

[11] Patent Number: 5,164,098

[45] Date of Patent: Nov. 17, 1992

[54] METAL CASTING METHOD AND APPARATUS

[76] Inventors: Charles D. Brown, 70 Woodvale, Coulby Newham, Middlesbrough, Cleveland, England; Denis O'Sullivan, Ty-Coch, Alwen Drive, CWM-Talwg, Barri, South Glamorgan, CF6 8HL, Wales

[21] Appl. No.: 631,360

[22] Filed: Dec. 20, 1990

[30] Foreign Application Priority Data

Dec. 27, 1989 [GB] United Kingdom ..... 8929193

[51] Int. Cl.[5] ..... B22D 41/16

[52] U.S. Cl. ..... 222/590; 266/272; 266/45; 222/597

[58] Field of Search ..... 222/591, 597, 602; 266/272, 271, 45

[56] References Cited

U.S. PATENT DOCUMENTS 2,328,267 8/1943 Freeman ..... 222/602
2,883,722 4/1959 Bidner ..... 222/602
3,540,627 11/1970 Armstead ..... 266/272
3,586,218 6/1971 Sharp ..... 222/602

*Primary Examiner*—Scott Kastler
*Attorney, Agent, or Firm*—Abelman Frayne & Schwab

[57] ABSTRACT

Metal casting apparatus comprises a casting container having an outlet nozzle in the bottom wall thereof, and an upright stopper within the container having a lower nose end thereto, the stopper being selectively movable between an operative position in which the nose end thereof seats on, to close, the nozzle and an inoperative position in which said nose end is displaced from, to open, the nozzle. The apparatus further comprises a barrier member positioned between the nose end of the stopper and the outlet nozzle and of a refractory material such as ceramic fibre capable of withstanding temperatures associated with pre- and post-heating of the apparatus but which is combustible at temperatures associates with molten metal, the material of the barrier member also being deformable whereby, with the stopper in its operative position, the barrier member conforms with the shape of the nozzle and the nose end of the stopper.

1 Claim, 3 Drawing Sheets

METAL CASTING METHOD AND APPARATUS

BACKGROUND OF THE INVENTION

This invention relates to metal casting apparatus and more particularly to such apparatus for casting measured quantities of molten steel.

It is well-established practice to provide metal casting apparatus including a container, such as a ladle, a tundish or a casting box, provided with an outlet nozzle in the base of the container, flow of molten metal from the container through the nozzle to an associated mould being under the control of an elongate stopper located vertically within the container and having a lower hose end co-operating with the nozzle whereby axial movement of the stopper relative to the container opens and closes the nozzle in accordance with the desired flow rate of the molten steel.

Prior to casting, the container and associated equipment are pre-heated, typically to a temperature of the order of 1000° C., to reduce the thermal shock of the refractory material when the container is filled with molten metal from the furnace, this molten metal being at a temperature of up to 1600° C.

The container is then positioned over a mould to be poured with the stopper seating in the nozzle to close the nozzle. The stopper is raised in a controlled manner to allow molten metal to flow into the mould, and, when the mould is full, the stopper is lowered to stop said flow of metal.

The container or mould is then moved on to allow the next mould to be poured and this sequence is continued until the container is empty of molten metal, the stopper then being lowered down to close the nozzle and locked in this position.

During the casting process, slag is formed within the container. The slag is lighter than the molten metal and therefore accumulates on the surface of the molten metal. Thus, once the container is emptied of molten metal, a quantity of slag remains therein around the lower end of the stopper and the nozzle.

Prior to refilling the container with a fresh supply of molten metal, it is necessary to remove the slag from the container and this is achieved by inverting the container whereby the slag can fall or be raked from the container.

However, the relatively fragile construction of the stopper support mechanism, and in particular the so-called rotor rod by which the stopper is conventionally attached to the transverse support arm, can result in damage to, or breakage of, the stopper during such inversion and therefore require replacement of the stopper at significant cost.

U.S. Pat. No. 450824 details a more rigid stopper support mechanism less prone to damage during inversion than the aforementioned conventional arrangements incorporating rotor rods.

After removal of the slag, the container and associated equipment are repositioned in their upright positions, preheated and refilled with molten metal for subsequent casting processes. The above-described procedure is then repeated.

However, serious problems can arise which adversely affect the working life of the component parts of the equipment, in particular the stopper.

The inevitable formation of slag and the collection of this slag around the nose end of the stopper together with the wear of the stopper, in particular the nose end thereof, that inevitably occurs during the casting process, combine to cause the nose end of the stopper to adhere to the nozzle. Thus, on subsequent raising of the stopper to open the nozzle, the adhesion of the stopper to the nozzle must first of all be overcome and this can and does result in breakage of the stopper such that a replacement stopper must be installed. Furthermore, even if the adhesion is overcome, there is often damage to the nose end of the stopper that can result in leakage paths from the container through the nozzle even with the stopper in the lowered position seating in the nozzle.

Thus it will be appreciated that the number of container fills for which a given stopper can be used is very variable and at the worst could be such as to require a separate stopper for each cast. Clearly this is financially and commercially unacceptable.

SUMMARY OF THE INVENTION

It would be desirable to be able to provide metal casting apparatus less prone to the aforementioned advantages and in particular in which the stopper is less prone to stick to the nozzle due to the presence of slag therebetween.

According to the present invention there is provided metal casting apparatus comprising a container for molten metal to be cast, said container including a nozzle in the base thereof for passage therethrough of the molten metal, and a substantially upright, elongate stopper within the container, said stopper having a lower nose end positioned adjacent said nozzle, the stopper being movable relative to the container between an operative closed position in which the nose end of the stopper seats on, to close, the nozzle and an inoperative open position in which the nose end of the stopper is displaced from, to open, the nozzle, characterized in that the apparatus further comprises a barrier member which, subsequent to emptying the container of molten metal, and with the stopper in its open position, is positioned between the nozzle and the nose end of the stopper, the barrier member being of a refractory material capable of withstanding temperatures associated with pre- and post-heating of the apparatus but which is combustible at temperatures associated with the molten metal, and being deformable whereby, on return of the stopper to its closed position, the barrier member conforms with the shape of the nozzle and the nose end of the stopper.

Thus it will be appreciated that, with the barrier member in position and with the stopper in its operative position, the opposed surfaces of the nose end of the stopper and the nozzle do not contact each other but contact opposed sides of the barrier member therebetween, which barrier member prevents adhesion of the stopper to the nozzle despite the accumulation of slag therearound.

Further, the deformable nature of the barrier member ensures that it acts as a seal between the nose end of the stopper and the nozzle, thus preventing leakage through the nozzle when the stopper is in its operative position even if the nose end thereof is damaged.

The combustibility of the material of the barrier member at the temperatures associated with the molten metal ensures that, as soon as the stopper is raised to its inoperative position remote from the nozzle, the barrier member is exposed to the molten metal and is combusted thereby.

Preferably the barrier member includes a peripheral portion disposed radially outwardly of the nose end of the stopper and of the nozzle, while it is further preferred that the barrier member is of generally disc shape.

Conveniently the barrier member comprises a ceramic fibre material, preferably KAOWOOL (registered trade mark).

The apparatus may be provided in combination with an applicator for locating the barrier member in its operative position between the nose end of the stopper and nozzle, the applicator preferably comprising an elongate member having a handle at or adjacent its upper end and support means at or adjacent its lower end adapted to receive thereon a barrier member, and holding means for retaining the barrier member on the support means during location of the barrier member into its operative position, said holding means being operable to release the barrier member into said operative position on removal of the applicator from the container.

DESCRIPTION OF THE PREFERRED EMBODIMENT

Figure 1:
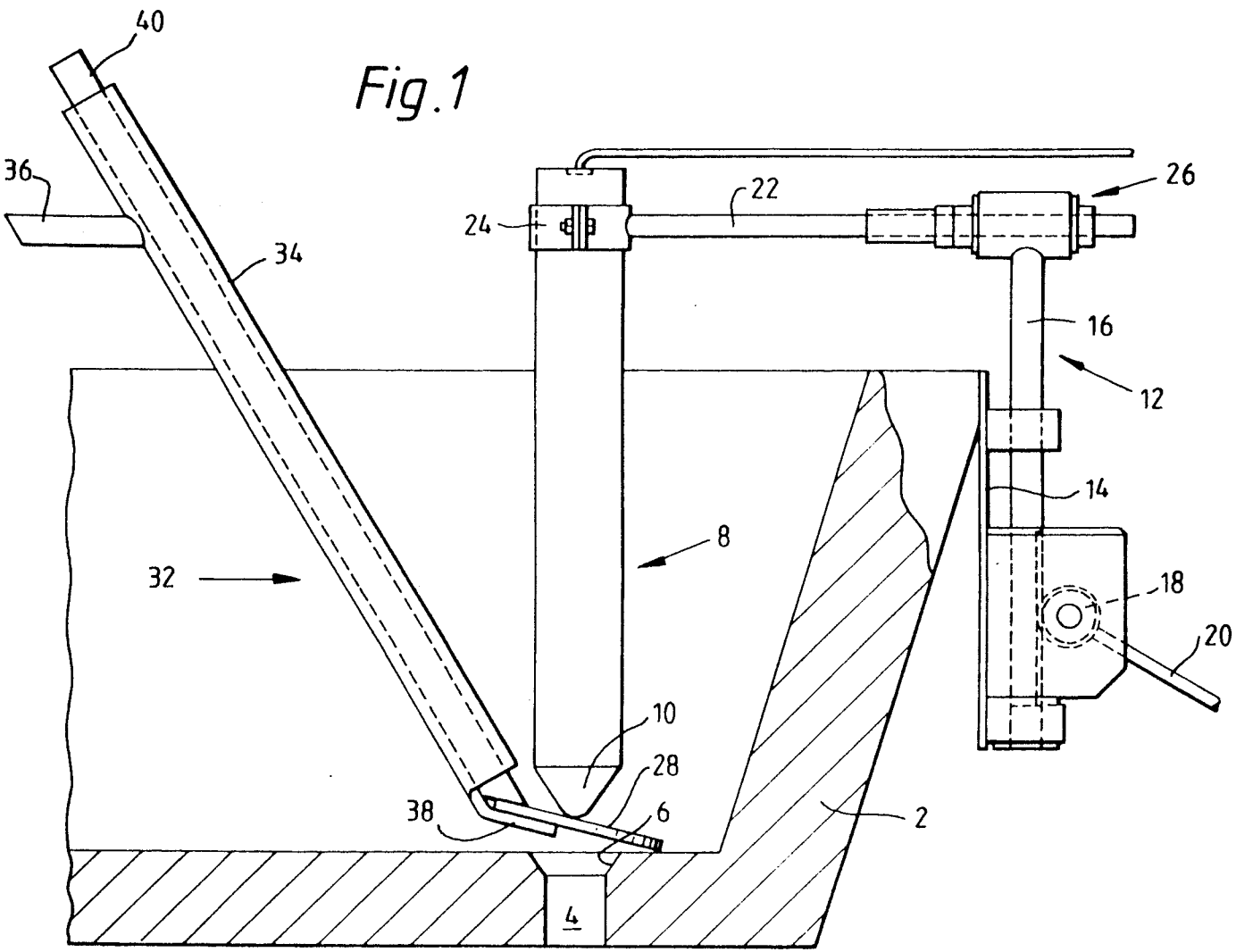
FIG. 1 shows part of apparatus according to the invention with the barrier member about to be located between the open stopper and the nozzle.

Referring to the drawings, there is shown part of a conventional casting container or tundish 2 having an outlet nozzle 4 in the bottom wall thereof for directing molten metal from the container 2 into an associated mould. The nozzle 4 includes an upper well portion 6 of generally concave form.

Located in an upright position within the container 2 is a substantially cylindrical stopper indicated generally at 8 and including a rounded nose end 10 shaped to seat in the well portion 6 of the outlet nozzle 4 to close said nozzle 4

The stopper 8 is carried by a mechanism indicated generally at 12 and mounted on a support plate 14 secured to the container 2. The mechanism is substantially as described in U. S. Pat. No. 4508247 and includes a main support shaft 16 mounted to the plate 14 and incorporating a rack with which co-operates a pinion 18 rotatable by means of a handle 20 to raise and lower the shaft 16 relative to the container 2 in conventional manner.

A transverse arm 22 interconnects the stopper 8 with the shaft 16, one end of the arm 22 carrying a clamp 24 which embraces the upper regions of the stopper 8, while a connecting block indicated generally at 26 secures the other end of the arm 22 to the shaft 16 in such a manner as to permit fore and aft and sideways movement of the arm 22 relative to the block 26 prior to securing the arm 22 to the block. The overall arrangement is such as to enable extremely accurate alignment of the nose end 10 of the stopper 8 with the well portion 6 of the nozzle 4 to be achieved.

As mentioned above, a major problem with the arrangement so far described is that, with the stopper 8 in its operative closed position, there is a tendency for the nose end 10 of the stopper 8 to stick to the well portion 6 of the outlet nozzle 4 because of the accumulation of slag therearound and whereby upward movement of the stopper from its operative position closing the nozzle 4 to its inoperative position opening the nozzle can be difficult to achieve and can result in damage to the nose end 10 of the stopper 8 and/or to breakage of the stopper 8.

In order to obviate this problem, there is provided a barrier member in the form of a disc 28 located between the nose end 10 of the stopper 8 and the well portion 6 of the outlet nozzle 4.

More particularly, the disc 28 is of a flexible high strength paper manufactured from ceramic fibre and marketed under the name KAOWOOL (registered trade mark). The inorganic constituents of the material of the disc 28 comprise between 50 and 53% of aluminum oxide ($A1_2O_3$) and between 47 and 50% if silicon oxide ($Si\ O_2$) with 50 p leachable chlorides, the material being capable of withstanding continuous temperatures of up to 1260° C. The material of the disc 28 includes about 6% organic binder, preferably an acrylic polymer, to give the paper its cold handling strength whilst still retaining its inherent flexibility. This binder will burn out at approximately 300° C. without the production of any acidic fumes associated with, for example, neoprene based binder systems as are commonly used in other high strength, high flexibility ceramic fibre papers.

Figure 3:
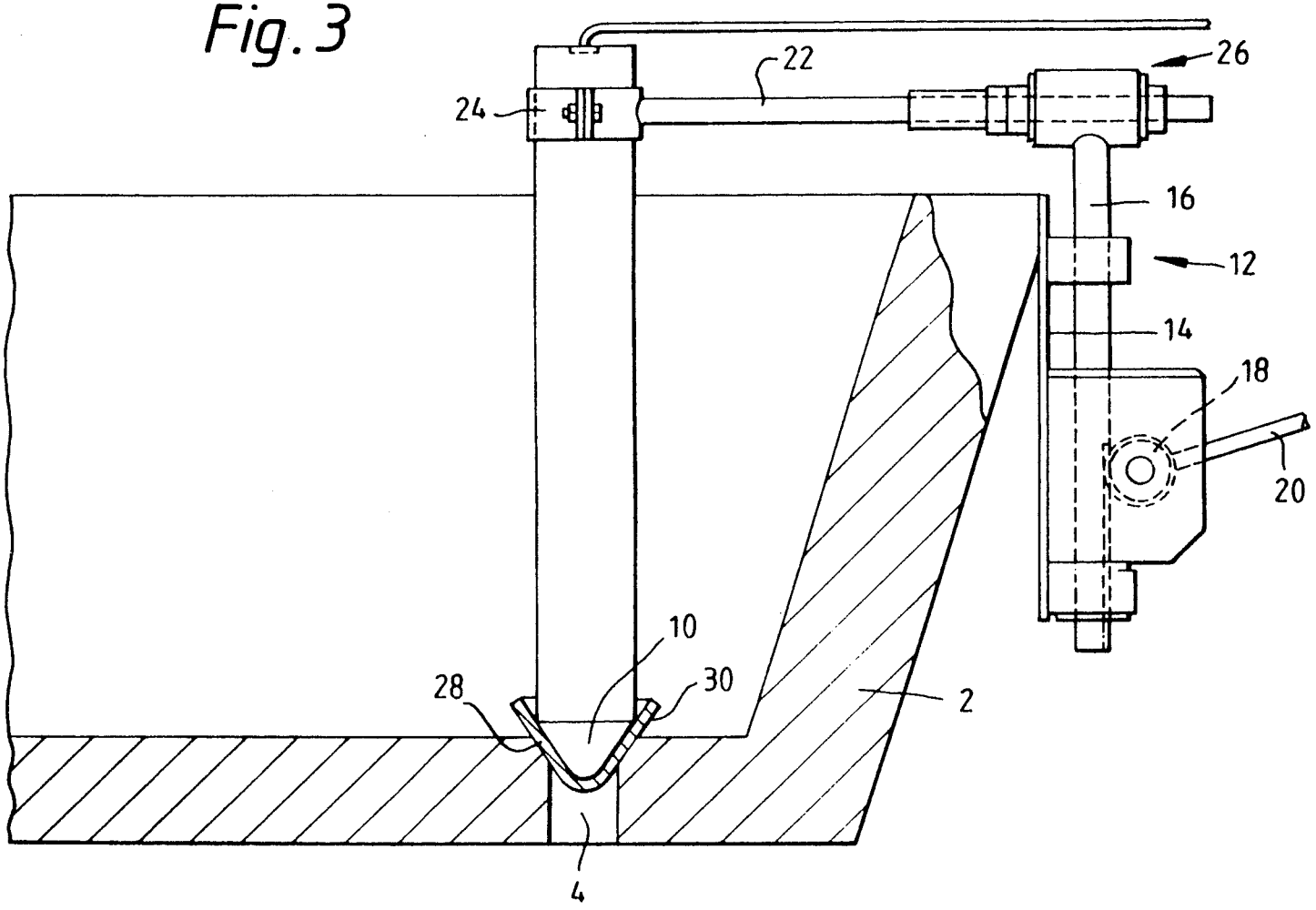
FIG. 3 shows the apparatus of FIGS. 1 and 2 with the stopper in its operative closed position.

The disc 28 is positioned over the well portion 6 of the outlet nozzle 4 between the well portion 6 and the nose end 10 of the stopper 8 and, with the stopper 8 in its lowermost operative position closing the nozzle 4, the disc 28 is compressed between the nose end 10 of the stopper 8 and the well portion 6 of the outlet nozzle to constitute a barrier between these components and to seal the nozzle 4 as shown in FIG. 3.

In this position of the disc 28, a peripheral region 30 thereof upstands from the remainder of the disc 28 to surround the lower regions of the stopper 8 for reasons which will become apparent.

Discs 28 are used as follows. Subsequent to the first pour of the apparatus using a new stopper 8, and which is effected without a disc 28 between the stopper 8 and the nozzle 4, the container and associated components are inverted with the stopper in its operative closed position to remove the slag that has formed during the casting process.

The container is then repositioned and the stopper 8 is raised to withdraw the nose end 10 from the well portion 6 and to permit the insertion of a disc 18 between the stopper 8 and the outlet nozzle 4 prior to refilling the container 2 with molten metal.

The disc 28 is inserted using the applicator indicated generally at 32 which comprises an outer hollow tube 34 having a handle 36 adjacent the upper end thereof and a support plate 38 extending across the lower end thereof and adapted to receive thereon a disc 28. A movable rod 40 extends the length of the tube 34 to seat on the plate 38 and to project from the upper end of the tube 34.

The disc 28 is positioned on the plate 38, the user holding the handle 36 of the applicator 32 with one hand and holding the upper end of the rod 40 with the other hand such as to clamp the disc 28 between the support plate 38 and the lower end of the rod 40.

Figure 2:
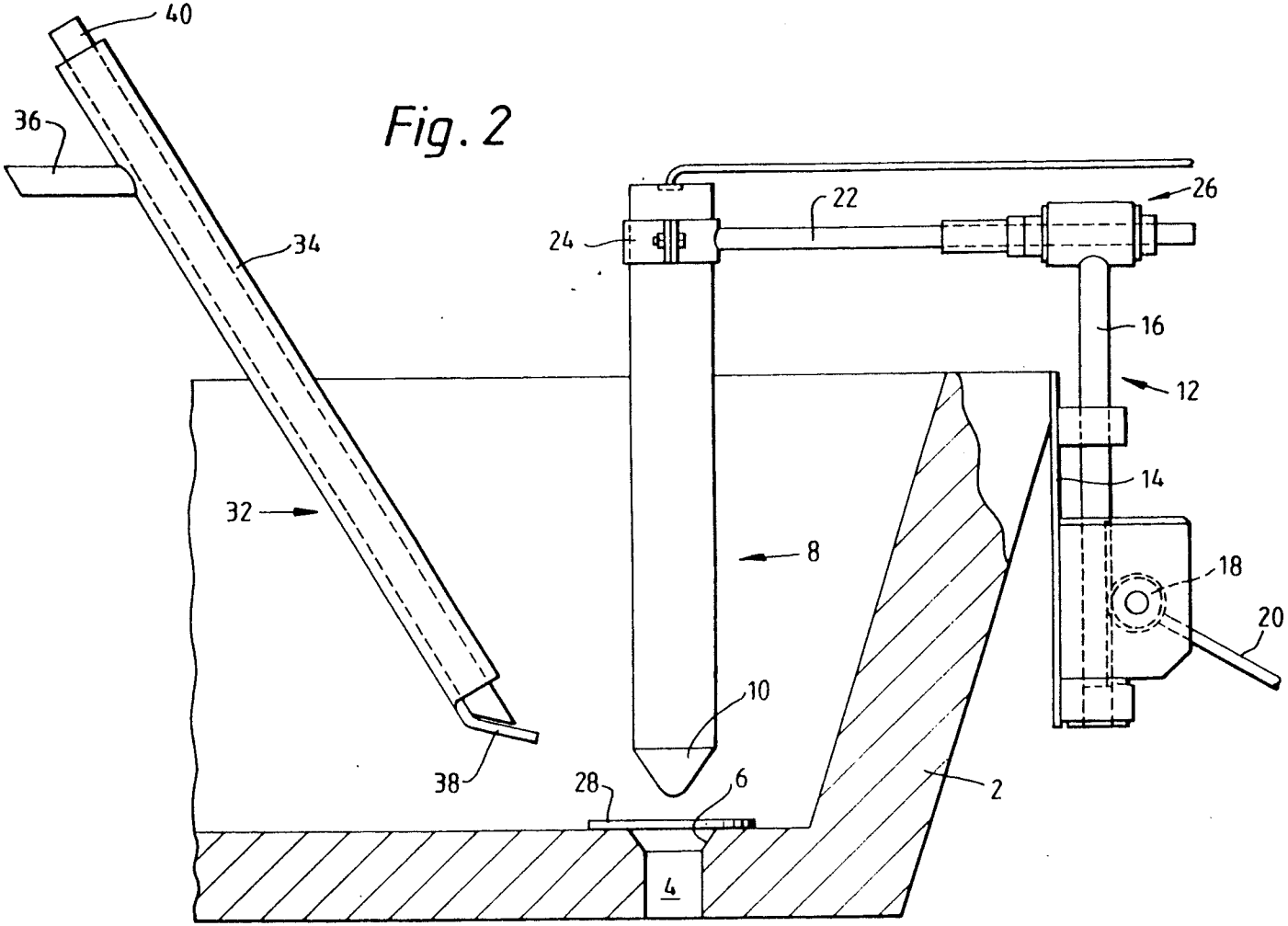
FIG. 2 shows the apparatus of FIG. 1 with the barrier member located between the open stopper and the nozzle.

The disc 28 is manoeuvred by the user into the position shown in FIG. 1, the rod 40 is moved upwardly to disengage the disc 28 and the applicator 32 is removed to leave the disc 28 across the well portion 6 of the outlet nozzle as shown in FIG. 2.

The stopper 8 is lowered to its operative position to deform the flexible disc 28 whereby said disc 28 conforms with the shape of the nose end 10 of the stopper 8 and the well-portion 6 of the nozzle 4 as shown in FIG. 3 and thereby seals the outlet nozzle 4 in preparation for the filling of the container 2 with a further batch of molten metal.

In this position of the stopper 8, the outer regions 30 of the disc 28 define an annular cup surrounding the lower end of the stopper 8 whereby any slag remaining on the stopper 8 is after inversion of the container 2 and subsequent repositioning thereof and gradually sliding down the stopper 8 received in the outer regions 30 of the disc 28 and is thereby prevented from contaminating the nose end 10 of the stopper 8 and/or the well portion 6 of the nozzle 4.

Thus the disc 28 provides a barrier member between the stopper 8 and the outlet nozzle 4 to prevent any adhesion of the nose end 10 of the stopper 8 to the well portion 6 of the nozzle 4 and such that subsequent upward movement of the stopper 8 to its inoperative open position can be effected without any damage to the stopper 8 or to the nozzle 4.

Further, the presence of the disc 28 as a seal between the stopper 8 and the nozzle 4 prevents any leakage past the nose end 10 of the stopper 8 that would otherwise occur if the nose end 10 of the stopper became worn or damaged as can occur on prolonged use of a stopper.

Once the disc 28 is inserted, and with the stopper 8 in its closed position, the apparatus is preheated to about 1000° C. in preparation for receiving a further quantity of molten metal, the physical properties of the disc 28 being such that the disc can readily withstand such temperatures.

The molten metal, at a temperature of about 1600° C., is then poured into the container, and the portion 30 of the disc exposed to the molten metal is immediately consumed thereby without the production of any acidic fumes because of the acrylic polymer binder used and whereby the molten metal is not contaminated or its quality impaired.

The remainder of the disc 28 continues to seal the outlet nozzle 4.

When it is desired to pour the metal, the stopper 8 is raised, there being no resistance to this raising from the lower regions of the stopper 8 because of the presence of the disc 28. On such raising, the remainder of the disc 28 is itself immediately combusted by the molten metal, again without any contamination thereof.

Thus the second pour from the container 2 can be readily effected with the original stopper 8 knowing that there will be no damage to the stopper 8 or the nozzle 4.

The above procedure can be repeated using the same stopper providing a barrier member is inserted subsequent to each pour and prior to refilling with molten metal, the presence of the barrier member enabling the apparatus to be left at ambient temperature for extended periods without the stopper adhering to the nozzle as would otherwise occur.

Thus the uncertainty normally associated with multipour processes is eliminated, and a single stopper can be used until it is worn out through normal usage, thereby significantly reducing the cost of casting equipment.

Heretofore, the temperatures associated with metal casting have been considered to provide a relatively unworkable environment not conducive to the introduction of supplementary means to overcome the long-standing problems associated with the casting process.

However, because of its refractory nature and its inherent physical and chemical properties, the described barrier member eliminates all these problems, and enables a continuous and consistent sequence of pours to be carried out at a much more economic cost than heretofore.

Further advantages of the disc 28 are that it insulates the stopper 8 from the outlet nozzle 4 whereby the refractory materials of these components stay hotter for longer, giving a better controlled start to the cast because the molten metal has less chance to chill around the nose end 10 of the stopper 8 and the outlet nozzle 4. Additionally, and prior to the provision of a barrier member, the apparatus had to be pre-heated for a considerable length of time to get the slag seal between the nose end 10 of the stopper 8 and the well portion 6 of the outlet nozzle 4 as hot as possible so that the molten metal subsequently poured into the container had a better chance of melting the slag and counteracting the adhesion of the stopper 8 to the outlet nozzle 4 on the first pour through the nozzle.

As the slag seal no longer exists, far less preheating of the apparatus is required, thus saving in energy costs.

What we claim and desire to secure by Letters Patent is:

1. A method of casting metal using apparatus including a container for molten metal having a base thereto, a nozzle in the base for the passage therethrough of the molten metal and a substantially upright, elongate stopper within the container, said stopper having a lower nose end positioned adjacent said nozzle, the stopper being movable axially within the container, the method comprising the steps of:

a) locating the stopper in an operative closed position within the container in which the nose end thereof seats on, to close, the nozzle;

b) pre-heating the apparatus;

c) supplying the container with molten metal;

d) raising the stopper axially within the container to an inoperative open position in which the nose end of the stopper is displaced from, to open, the nozzle and whereby molten metal flows from the container through the nozzle;

e) after the completion of a final pouring operation, then positioning a mechanically-deformable sheet of a thermally destructible material over the said nozzle, then lowering the stopper onto said sheet of material to force said material partially into said nozzle with said sheet material interposed between said stopper and the adjacent wall of said nozzle, said sheet material being thermally stable at the then existing temperature of said stopper and said nozzle, and being thermally destructible at a temperature lower than that of the next batch of molten metal to be introduced into said container for a succeeding pouring operation, whereby, on pouring of a new batch of said molten metal, that portion of said sheet that is directly exposed to the poured molten metal is conflagrated and thermally destroyed, that portion of said sheet material that is entrapped between said stopper and said juxtaposed nozzle wall remaining mechanically intact, and providing a seal and parting agent between said stopper and said juxtaposed wall of the nozzle, until such time as the stopper is moved axially upwards to permit discharge of said molten metal from said container through said nozzle; and, f) repeating steps b) to e) utilizing the same stopper.

* * * * *